United States Patent [19]

Puritz et al.

[11] B 4,000,774

[45] Jan. 4, 1977

[54] REGENERATIVE AIR PREHEATER WITH AUTOMATICALLY ADJUSTABLE SEALING DEVICE

[75] Inventors: Ernst Puritz, Dahlbruch; Erich Kraft, Huettseifen, both of Germany

[73] Assignee: Apparatebau Rothemuhle Brandt & Kritzler, Rothemuhle, Germany

[22] Filed: Jan. 30, 1973

[21] Appl. No.: 328,116

[44] Published under the second Trial Voluntary Protest Program on March 9, 1976 as document No. B 328,116.

[30] Foreign Application Priority Data

Feb. 8, 1972 Germany ..... 2205838

[52] U.S. Cl. ..... 165/4; 165/9

[51] Int. Cl.[2] ..... F28D 17/00

[58] Field of Search ..... 165/9, 7, 4

[56] References Cited

UNITED STATES PATENTS

| | | | |
|---|---|---|---|
| 2,852,234 | 9/1958 | Mudersbach | 165/9 |
| 3,246,687 | 4/1966 | Jensen et al. | 165/9 |
| 3,250,316 | 5/1966 | Nyberg | 165/9 |
| 3,321,010 | 5/1967 | Brandt et al. | 165/4 |

*Primary Examiner*—Albert W. Davis, Jr.
*Attorney, Agent, or Firm*—Elliot A. Lackenbach

[57] ABSTRACT

A regenerative air preheater with cylindrical regenerator chamber and sealing frames at its axial ends with adjustable automatic thermal compensating devices for uniformly maintaining a constant sealing gap by adjustable means under different heat distortions of the regenerator chamber. The sealing frames are movable on spring-loaded pins and the axial travel of said frames is automatically equalized to the axial distortions of the regenerative chamber by said automatic thermal compensating devices in such a way, that they may follow the axial distortion movement of the regenerator chamber in a constant distance of a predetermined sealing gap, which had been adjusted, said compensating devices are controlled by their temperature-responsiveness, preferably in accordance with the mean temperature difference across the mass. As shown, they are made up by partially compensating thermal expansive devices, tied to a lever linkage with adjustable means.

12 Claims, 6 Drawing Figures

REGENERATIVE AIR PREHEATER WITH AUTOMATICALLY ADJUSTABLE SEALING DEVICE

FIELD OF THE INVENTION

This invention relates to regenerative air preheaters. It applies both to the type which has a stationary cylindrical regenerative mass, with rotatable hoods at its end faces for collecting one of the heat-exchanging media and also the type where the regenerative mass rotates and collection ducts are stationary.

The invention is more applicable however to the stationary mass type.

BACKGROUND OF THE INVENTION

There are always sealing arrangements between the hoods and the regenerative mass and these take the form of sealing elements, such as sealing frames with wear shoes, which are held adjacent the end surfaces of the regenerative mass or slidingly pressed on them under resilient loading.

When the regenerative mass heats up distortion occur because it is not uniformly heated. It has a "hot end" and a "cold end". The effect of this is that the sealing frames have to be adjustably positioned.

It is known in the art to spring-load pins which bear the frames so that if the mass comes into contact with them, they are driven back. This, however, results in increased wear of the wear shoes, and the range of movement available may not be sufficient to allow adequately, in some conditions arising, for the amount of adjustment which is desirable.

An automatically responsive element for causing the adjustment of rigid sealing elements, here sealing plates, at one or both ends of a rotation regenerative mass has previously been proposed in United Kingdom Patent No. 1058627 and U.S. Pat. No. 3,246,687. In this arrangement a thermally expansible element preferably in the form of a duct for gases is arranged parallel to the axis of the rotary mass regenerator and is linked at the level of at least one of the ends of the regenerative mass with the sealing plate. In one arrangement the other end of the duct is firmly anchored to a fixed casing of the mass, while in an alternative arrangement each end of the duct is floating and secured to the respective sealing plate. The effect on temperature rise is to drive the sealing plate or the sealing plates away from the respective ends of the regenerative mass.

The effect however of temperature rise on the mass itself is to cause it to adopt a calotte shape with the hot end being convex and the cold end concave. So it would be desirable on temperature rise that the hot end sealing plate should in fact be drawn towards the regenerative mass and not pushed away from it. Thus, the arrangement shown in the U.K. Patent No. 1058627 while having the effect which that specification states it has, that of reducing the possibility of interference between the rotor and the sealing plate, also has the effect of increasing the gap between at least one of the sealing plates and the end of the mass over which it is placed.

This duct being a simple expansion part which is associated with the ducts and hoods means that the extent of the adjusting movement cannot be influenced freely but is limited to what can be used in this constructional part at the temperatures which are to be sensed.

It is to be noted that the control selected for the determination of the amount of thermal expansion is the cooled gas that has passed through the regenerative mass and has given up its heat to it. This temperature under normal operating conditions is comparatively low and does not offer much sensitivity for the available response of the temperature responsive device. Therefore, in normal operation the response of this device offered is negligible and cannot be considered as a control for seal-setting. Only in case of an abnormal rise of the cold end temperature, as it may happen during "startup", "shutdown" or "when the flow of air or other cool fluid through the heat exchanger has been substantially curtailed" the outlet temperature of the cooling fluid may rise to a degree that the temperature-sensitive device will respond. In this case the response will act not for an optimum seal-setting but in the contrary such, that the seals are moved completely away from the end faces of the regenerative mass.

The present invention is concerned with providing for automatic adjustment of the limits of setting of the sealing elements at the end faces of the regenerative mass in accordance with the actual operating conditions at any given time, and for ready selection and control of that adjustment.

SUMMARY OF THE INVENTION

The present invention provides, a rotary regenerative air preheater in which stop for the sealing elements are arranted to be automatically driven by temperature responsive means towards the hot end of the regenerative mass and away from the cold end of that mass upon temperature rise, and vice versa on temperature fall. Then, if the nature and response of the temperature-responsive devices are rightly chosen, a given gap between the sealing element and the end face, or a pressure of contact between them governed by the action of springs loading the elements upwardy, may be maintained even when the mass develops its calotte-like distortion.

In a preferred form this is achieved by providing separate temperature-responsive devices at the respective ends of the mass, respectively coupled to the stops for the sealing elements at those ends and being of a character at the hot end so that there is movement of the sealing element stop towards the mass on temperature rise and at the cold end so that there is withdrawal of the sealing element stop from the mass on temperature rise. Conveniently the or each temperature responsive device takes the form of a compensating expansion arrangement including two elements, a first of which is fixedly mounted upon a support and a second of which is movable mounted on the support, the first and second elements being spaced apart by material of a first coefficient of thermal expansion, and a third element adjacent the first and movably mounted on the support, the spacing of the third element from the second element is determined by a material of a second and different coefficient of thermal expansion, whereby a change in temperature causes a displacement of the third element relative to the first by the difference in coefficients of thermal expansion. By arranging that the first coefficient of thermal expansion is greater than the second, the third element may be moved towards the first on temperature rise, and by arranging that the first coefficient of thermal expansion is smaller than the second, the third element may be moved away from the first on: temperature rise, these respective movements being convertable through an appropriate lever linkage to the appropriate movement of the stop for the sealing element, e.g. a sealing frame, towards or away from respectively the ends of the regenerative mass on temperature rise, and vice versa on temperature fall.

It is further preferred to control the response of the or each temperature sensitive device with reference to the mean temperature drop across the regenerative mass. Alternatively, it or they may be governed with reference to the tendency for a gap to open between the sealing element at one end of the mass and the mass itself. In either case the response is obtained by converting the selected reference parameter to control the temperature of a controlled environment of at least one of the temperature responsive devices.

Preferably also, we use flexibile sealing frames, and may further control their shape, progressing radially from the central axis of the preheater, by having automatic adjustment at the outer circumference of frames, a conventional position, but also at a position radially between the circumference and the central axis.

The gas temperature ($t_{ga}$) at the cold end of the air preheater used for control of the stated prior art seal adjustment means does not conform with the actual deformation of the end faces of the regenerative mass which experience shows in directly proportional to the means temperature difference dt between the heat-exchanging gases. That is to say:

$$dt = \frac{tge + tla}{2} - \frac{tga + tla}{2}$$

where $t_{ga}$ and $t_{ge}$ are the gas outlet and inlet temperatures and $t_{le}$ and $t_{la}$ are the air temperatures at inlet and outlet and $dt$ is the mean temperature difference referred to above.

DESCRIPTION OF PREFERRED EMBODIMENTS:

Figure 1:
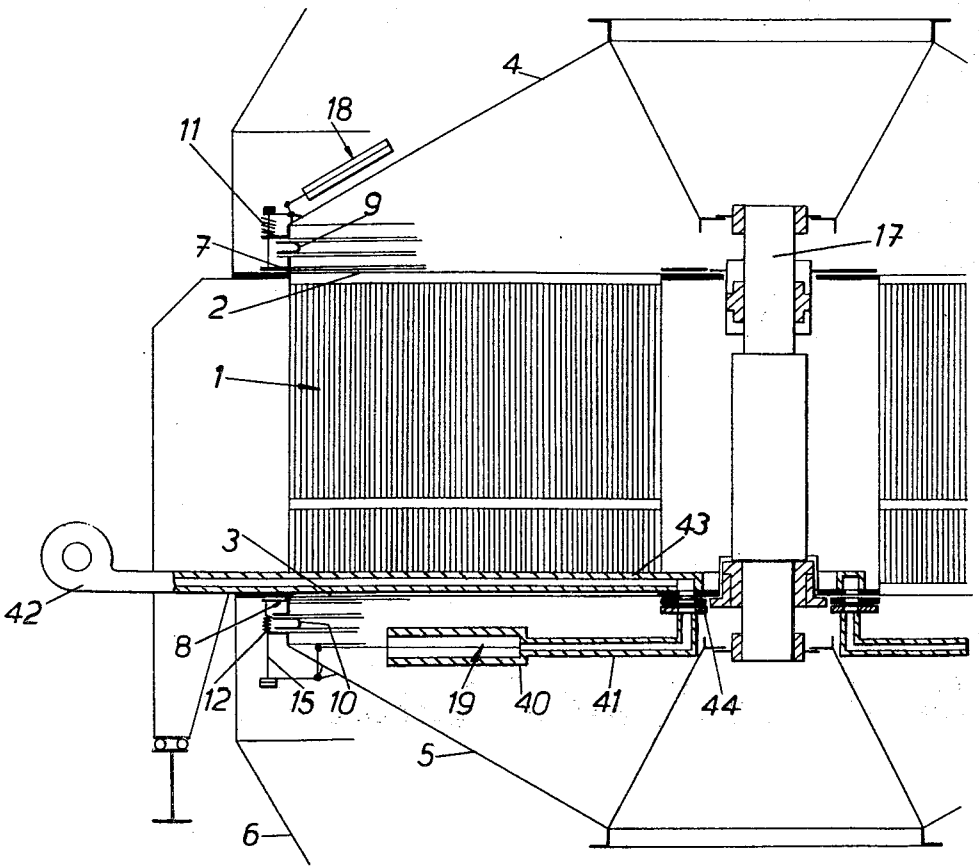

The invention is applicable, as has been stated, both to the forms of air preheater where the regenerative mass is stationary and where it rotates, but the following argument and description will be given with reference solely to the stationary mass type.

Figure 2:
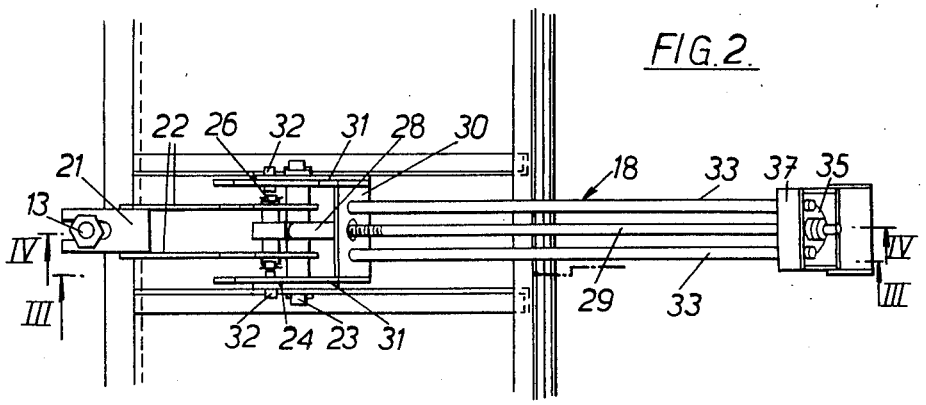
Figure 3:
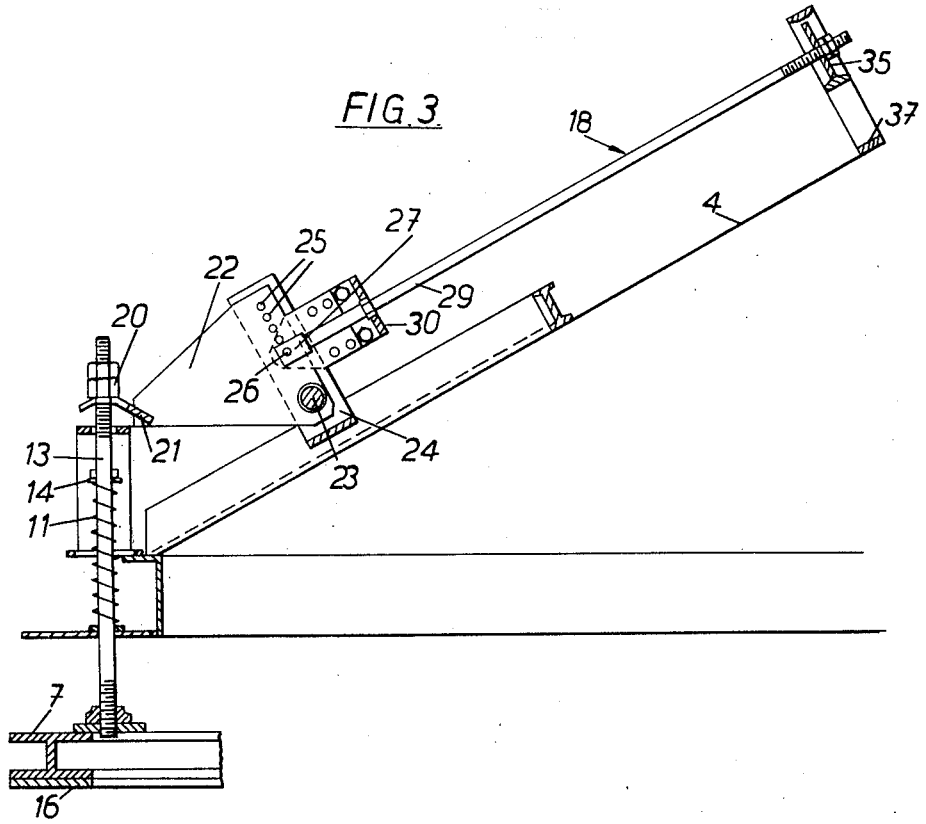
Figure 4:
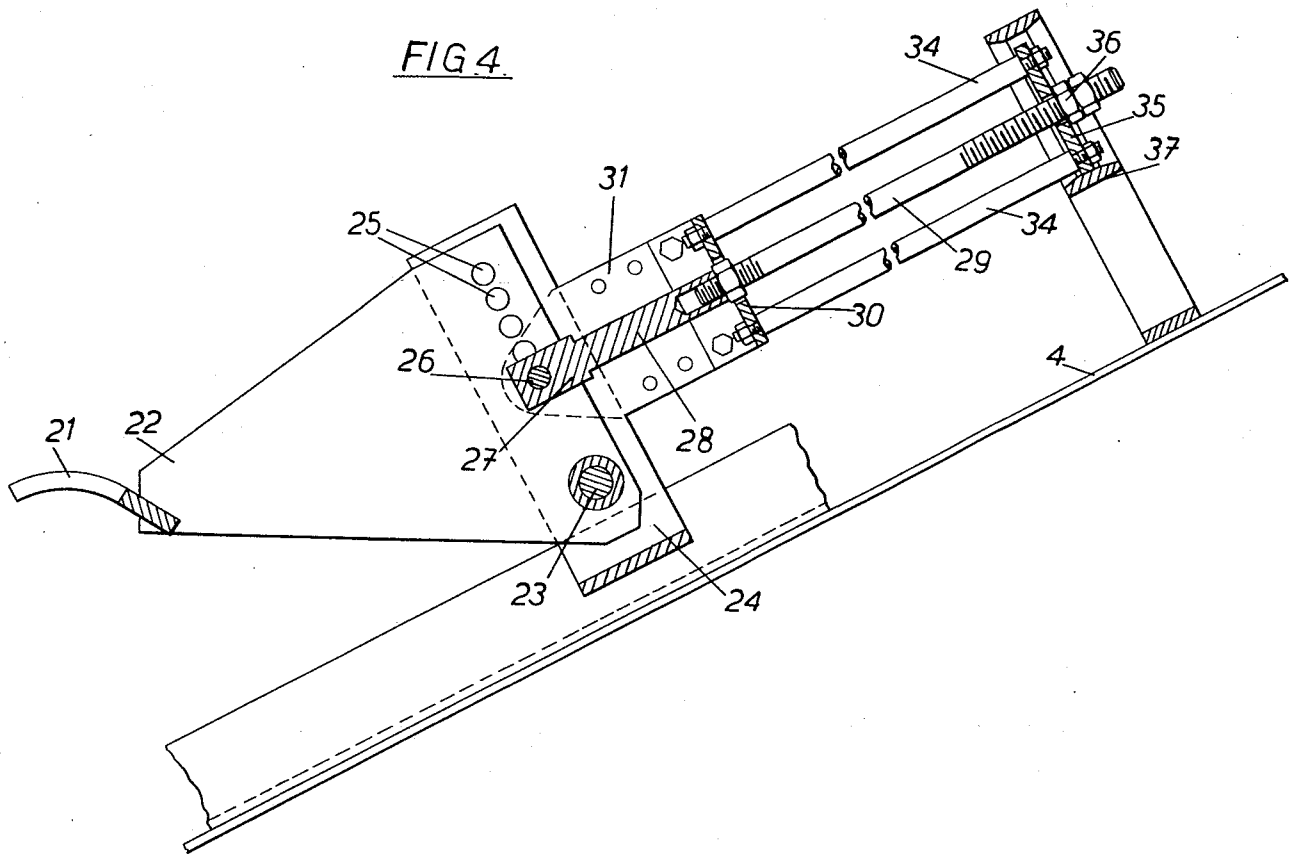
Figure 5:
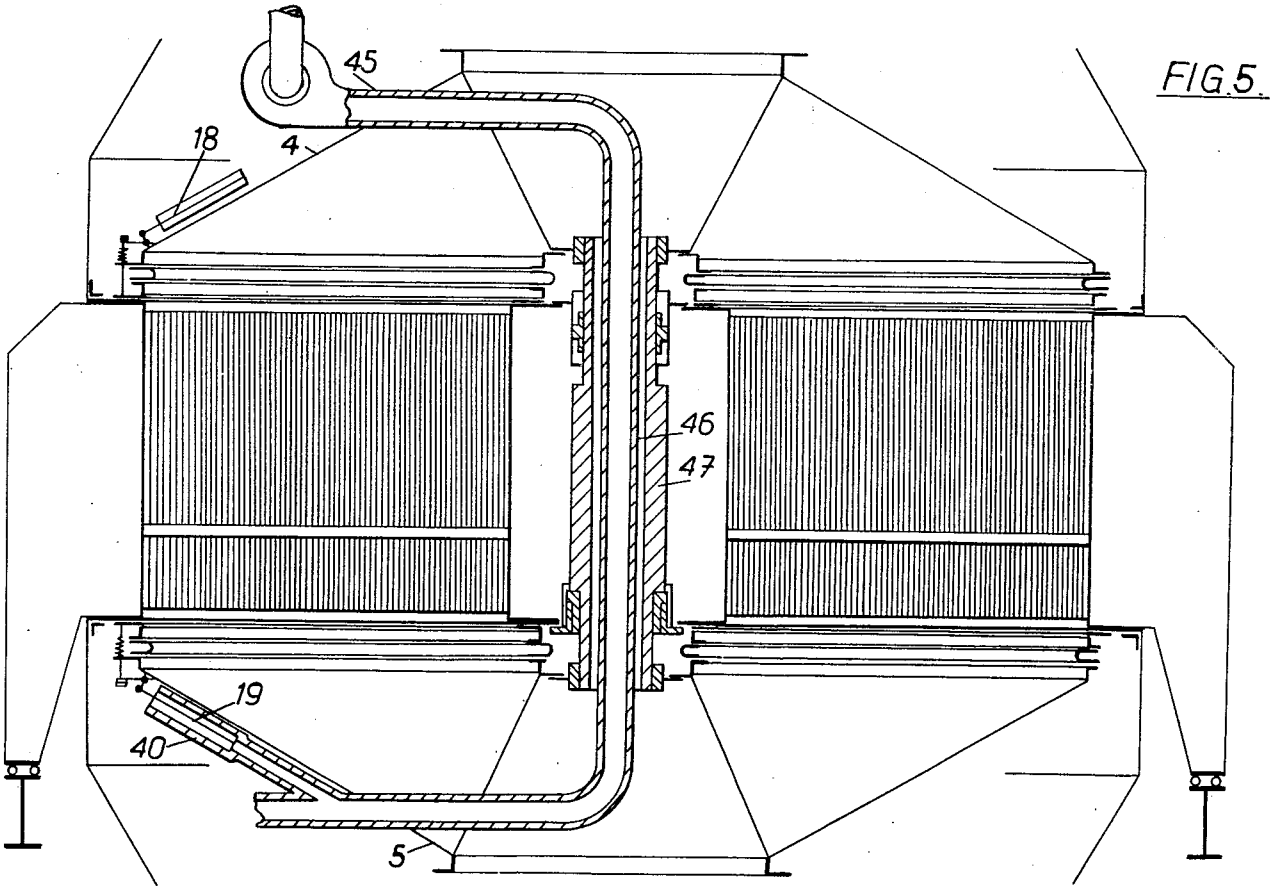
Figure 6:
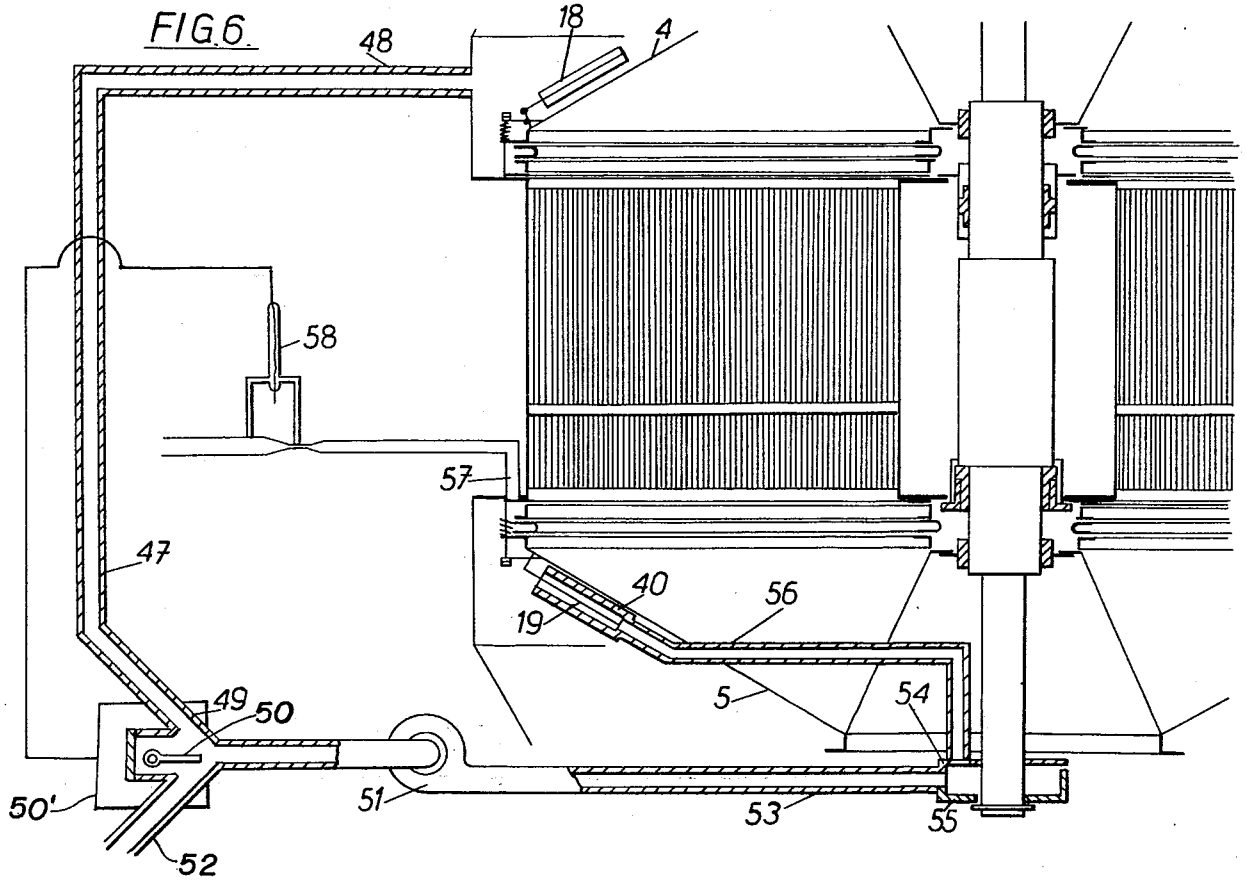

Examples of embodiments of the invention are shown diagrammatically in the accompanying drawings. In the drawings:

FIG. 1 shows a section on one diameter through a stationarymass rotary regenerative air preheater with rotating hoods, FIG. 2 is a plane view of an automatic adjustment device, FIG. 3 is a section on the line III—III of FIG. 2, FIG. 4 is a section on the line IV—IV of FIG. 2 but showing an alternative arrangement of thermal expansion elements, and FIGS. 5 and 6 show respectively in diametrical section rotary regenerative preheaters with means alternative to those in FIG. 1 for controlling the behaviour of thermal expansion devices.

In FIG. 1 a rotary regenerative air preheater has a stationary, radially segmented, mass with an axial end face 2 at its hot end and an axial end face 3 at its cold end. The mass is stationary and symmetrically arranged rotating air hoods 4 and 5 are arranged respectively at the hot and cold ends to connect the mass to one of the media to pass through it. The other one of the media passes through the mass around the hoods, being contained by a general casing 6 for the preheater.

The hoods 4 and 5 have sealing elements in the form of frames 7 and 8 respectively which pass across the end faces of the regenerative mass to seal between the hoods and that mass. They are linked to the hoods by an expansion seal 9, 10, respectively, and urged into a controlled pressure of engagement with those end faces. In the case of the upper frame 7 it is urged into engagment by gravity, but its weight is relieved in a resilient manner by a counterbalancing spring 11 which is set on a spring pin 13 by an adjustable stop 14.

On the cold end or undersurface of the mass, the frame 8 is urged away from the mass by gravity but this is overbalanced by a spring 12 mounted between the hood and another adjustable stop on the corresponding pin 15. The sealing frames 7 and 8 are elastically flexible so as to conform with the calotte warping of the end face of the regenerative mass which will occur when a temperature difference builds up across the mass. They include wear shoes, part of one of which is indicated at 16, FIG. 3.

The sealing frames and shoes are borne on a central shaft on the regenerator indicated at 17, FIG. 1, and are in the shape of a segment of an annulus.

Automatic adjustment of the position of the sealing frames relative to the hoods is provided by thermal expansion devices indicated generally at 18 and 19 of FIG. 1, and spaced round the circumference of the frames. Only one will be described, with particular reference to FIGS. 2, 3 and 4.

The spring pin 13 has at its upper end adjustable wear-limitation lock nuts 20 under which engages a curved fork 21 which acts as a movable stop to delimit the amount of travel available to the lock nuts 20. The fork 21 is fixed between twin lever plates 22 which are journalled on a shaft 23 in a fixed bracket 24 secured to the surface of the upper hood 4. Along its edge remote from where the curved fork 21 is attached, each plate 22 has a series of apertures 25 between any pair of which may be fastened by means of a pivot pin 26, a boss end 27 of a screwthreaded socket 28 to which is locked an expansion rod 29. The expansion rod 29 passes freely through an aperture in a cross-member 30 to which are fixedly attached side plates 31, which are received in apertures in the fixed bracket 24 which are at equal radii from the axis of the shaft 23 as the respective pairs of apertures 25 in the lever plates 22. The side plates 31 may be secured by means of pins 32 passing through any selected pair of apertures in the bracket 24 so that the pins 32 and 26 may all lie coaxially.

Also secured to the cross-piece 30 are expansion rods 33 lying one each side of the expansion rod 29 and/or expansion rods 34 lying one above and one below the rod as shown in FIG. 4.

At their ends remote from the cross-member 30 the expansion rods are received by a plate 35 to which rods 33 and/or 34 are fixedly attached, and through which the rod 29 freely passes, lock nuts 36 being provided on the screw-threaded end of the rod 29 beyond the plate 35. The plate is slidably borne in a fixed bracket 37. The rod 29 is arranged to have a higher coefficient of thermal expansion than the rods 33 and/or 34. An example of this material of higher expansion is a steel containing 20 percent wt Ni and 6 percent wt Mn and of the smaller expansion a steel containing 42 percent Ni by weight. The difference between the expansions of one metre rod lengths of these materials at a temperature of about 350°C is 5 millimetres or thereabouts.

The working of this expansion device is as follows: remembering that the sealing frame is attracted downwards by gravity, the lever plates 22 are tending to be pulled anti-clockwise. This movement is resisted by the rods 34 being placed under compression by the tension developed in the rods 29 between the shaft 26 and the lock nuts 36 which latter bear on the plate 35. Upon a rise in temperature the expansion rod 29 expands and tends to allow the lever 22 to rotate anti-clockwise, permitting lowering of the pins 13. However, the same rise in temperature will cause expansion of the rods 33 and/or 34 so that the plate 35 slides in the bracket 37 and is moved further away from the cross bar 30 and shaft 26. As has been mentioned, the coefficient of thermal expansion of the rods 33/34 is less than that of the rod 29 and therefore the net result of rise of temperature is to move the pin 26 leftwards in the figure so there is still a lowering of the fork 21, (hence a lowering of the pin 13 will be permitted), but the partial compensation by the rods 33/34 allows, by selection of the materials and lengths of the various rods, extremely precise control of the response characteristics of the expansion device. For greater control, more than one rod of greater expansion may be provided in combination with more than two rods of lesser expansion, with a plurality of end plates 35 and crossmembers 30.

Selection of a particular one of the apertures 25 allows for selection of the response by the pin 13 to a given degree of expansion in the expansion device.

Because of the lowering of the fork 21, if the wear limitation nuts 20 were engaged by the fork 21, so that there was a slight gap between the wear shoe and the mass, the pin 13 will move down. But if at that time the axial movement of the sealing frame has not been such as to exceed the freedom allowed by the setting of the nuts 20, the spring 11 will still be acting and the pin 13 will not necessarily follow the fork 21 downwards. This allows, however, spring pressure relieving the weight of the frame 7 to be exerted over a wider range of movement than if a stop for the lock-nuts 20 were axially fixed.

The expansion devices and lever linkage provided at the cold end are in principle similar, with the exception that it is the rods of greater expansion which are tied to the crossmember (30) and end plate (35) and that of lesser expansion which is placed under tension so that the nett result of a temperature rise is that the pin 15 is withdrawn downwardly.

FIG. 1 shows one means of controlling the temperature response of the thermal expansion devices.

The regulation of the temperature at which the expansion are, is effected directly by gases which flow around the rods. In the case of the upper device 18 the rods are at the temperature of the heating gases which pass through the casing 6 and then into the mass. The cold-end device 19 is not at its ambient temperature; it is surrounded by a thermally insulated jacket 40 which is fed from a duct 41 with gas at a controlled temperature, the input of which is from a fan 42. The gas blown in is at a temperature controlled to be at a temperature $t_s$ regulated in dependence of the value dt. The measurement of this value dt is effected by thermo-couples in a manner known per se and the temperature $t_s$ is achieved by electrical heating elements before or after the fan 42. There is a rotatable connection between the stationary portion 43 of the duct and the portion 42 which moves with the hoods, this connection being indicated at 44.

By selection of the respective materials of the rods there can be chosen an appropriate response for an expected temperature range of working. Selecting the distance from the axis of the shaft 23 at which the boss 27 and the side plates 31 are attached respectively to the bracket 24 and to the lever arm 22 controls the degree of response of a given length of given material to a given amount of temperature change; by selecting the numbers of rods of equivalent length and material in parallel the strength at which the lever is moved may be controlled.

The parameter which is selected to control the environment of at least one of these temperature responsive devices may be as has been illustrated in the first embodiment or may be that shown in FIG. 5 or FIG. 6. In all of these cases however there is the common factor that the control is due to a regulated temperature.

We have explained how in FIG. 1 the temperature of the controlled gas flowing through the duct 41 to the chamber 40 and around the device 19 is governed in accordance with the mean temperature difference *dt* of heat exchanger gases as calculated in the formula given above. The measurement of the various gas and air temperatures is done in known manner by thermo couples installed around the regenerative mass; the heat for the gas is produced by electric heating coils, for example, before or after the fan 42.

In FIG. 5 however, the temperature of gases in the chamber 40 surrounding the device 19 is based on an assumption that, in many cases at least during normal running, the temperature of hot gas at the input end, *tge*, will as a first approximation be in direct proportion to the quantity *dt*. In the case of this embodiment both the upper temperature sensitive device and the lower one 19 are kept at temperature *tge* by a duct 45 of which an inlet end is available to the gas above the hood 4 and an outlet end is in the chamber 40. The duct passes at 46 through a hollow central shaft 47 of the regenerative air preheater of this embodiment and it rotates with the hoods.

In FIG 6 we show how control of the lower temperature responsive device may be achieved by taking out hot gases through duct 48 which passes through a Y-junction 49 controlled by a flap valve 50. The outlet end of the Y junction goes to a fan 51 and the other inlet branch 52 is open to the ambient atmosphere. By adjusting the setting of the flap valve 50 the temperature of air passed by a fan 51 can be controlled. The output from this fan goes through a duct 53 through a rotating connection at 54 formed with circular trunking 55, to a further duct 56 leading to the chamber 40 surrounding the temperature sensitive device 19.

The setting of the flap valve may be controlled in dependence on the value *dt* determined as before or by detecting the size of the gap between the sealing frame and the end face of the regenerative mass. An expedient method involves directing a jet of air from a nozzle 57 against a flange surface of the frame, the gap size being determined by the back-pressure sensed by variable conductive device 58, electrically controlling the setting of the shutter 50 by a device 50'. The compressed air jet is only operated during the period during rotation of the hoods when the flange of the sealing frames are in position below its nozzle 57.

When we have talked of the frames being moved away from or towards the mass we refer to the direction of their displacement relative to the original position of the mass; this, because of its distortion, moves, at its circumference, substantially the same amount as the sealing frame stops 21 so there is in fact little or no relative axial displacement if the devices are correctly set.

We claim:

1. Rotary regenerative air preheater with a cylindrical regenerative mass having a central axis and end faces, sealing elements adjacent, respectively, the end faces of the regenerative mass, the sealing elements being operatively linked to spring loaded pin means adapted for travel in the axial direction of the mass and respective stops defining a limit to the travel of the respective pin means, a temperature responsive device at each end face of the mass, each stop being operatively linked to a respective temperature responsive device through a lever linkage including a crank means, the crank means being borne on a support for pivoting about a pivot axis, the temperature responsive devices being attachable to the crank at any one of a plurality of distances from the pivot axis, and being responsive to alter its length will alteration in temperature to adjust axially the position of said stop, the device at one end of the mass being arranged to cause said stop for the sealing element at the end to move in a given axial direction upon temperature rise and that at the other end of the mass being arranged to cause said stop for the sealing element at the end to move in the same axial direction on temperature rise, both stops being moved in the opposite direction on temperature fall, the directiions bein appropriate to the axial movement of the mass with temperature change

2. A preheater according to claim 1, wherein each temperature responsive device has a plurality of compensating rods of differing coefficients of thermal expansion, whereby the net temperature response is a function of the difference between the coefficients.

3. A preheater according to either of the claim 1 wherein means are provided for causing at least one of the devices to have a temperature different from the ambient temperature at the respective end of the regenerative mass.

4. A preheater according to claim 3 further comprising means for controlling the temperature of the device at a value dependent on the mean temperature difference across the regenerative mass.

5. A preheater according to claim 4 wherein means are provided such that the temperature at which the device is held is dependent upon the tendency of an end face of the regenerative mass to move axially relative to the sealing element at the end.

6. A preheater according to claim 1 wherein means are provided for controlling the temperature of the gas passed by mixing of input gas and of air at ambient atmospheric temperature.

7. A preheater according to claim 1 wherein the said sealing elements are flexible.

8. A preheater according to claim 7 wherein the said devices are provided to act at the circumference of the mass and additional said temperature responsive devices are provided and linked to the elements between the centre axis of the regenerative air preheater and the circumference of the preheater, whereby to controllably distort the flexible sealing elements.

9. Preheater as claimed in claim 1 wherein means are provided so that at least one of the temperature responsive devices is kept in a controlled temperature environment, each temperature responsive device being actuated in accordance with the temperature which it is at.

10. A preheater as claimed in claim 1 wherein means are provided for passing gas over at least one of the devices at a selected temperature different from the ambient temperature at the relevant end of the regenerative mass, the temperature being controlled such that the stops and the mass remain in substantially unchanged axial relationship.

11. A preheater as claimed in claim 10 wherein the lever linkage comprises a curved fork as the said stop, the pin means passing freely between the legs of the fork and the convexly curved surface of the fork defining a stop surface for a bolt on the pin means.

12. A preheater as claimed in claim 1 wherein means are provided for passing gas at a temperature essentially that at the hot end of the regenerative mass over the temperature responsive device at the cold end of the regenerative mass, whereby to maintain that device at a temperature different from the ambient temperature at the cold end of the regenerative mass, a gas duct leading from the hot end of the mass to the cold end to pass gas from the hot end to the device at the cold end.

* * * * *